US005673824A

United States Patent [19]

Evans

[11] Patent Number: 5,673,824

[45] Date of Patent: Oct. 7, 1997

[54] PLASTIC DOSING PUMP FOR DISPENSING LIQUIDS FROM CONTAINERS

[75] Inventor: Santagiuliana Evans, Vicenza, Italy

[73] Assignee: Taplast Srl, Dueville, Italy

[21] Appl. No.: 455,499

[22] Filed: May 31, 1995

[51] Int. Cl.[6] ..... B67D 5/42

[52] U.S. Cl. ..... 222/321.9; 222/321.1; 222/340

[58] Field of Search ..... 222/207, 321.2, 222/321.7, 321.9, 340

[56] References Cited

U.S. PATENT DOCUMENTS

| | | | |
|---|---|---|---|
| 3,223,292 | 12/1965 | Keeney et al. | 222/321.9 |
| 3,228,571 | 1/1966 | O'Donnell et al. | 222/321.9 |
| 3,359,917 | 12/1967 | Cooprider | 222/321.9 X |
| 3,362,344 | 1/1968 | Duda | 222/321.9 X |
| 3,463,093 | 8/1969 | Pfeiffer et al. | 222/321.9 X |
| 4,071,172 | 1/1978 | Balogh | 222/321.7 |
| 4,252,507 | 2/1981 | Knickerbocker | 222/321.2 X |
| 5,096,094 | 3/1992 | Guilbert | 222/321.9 X |
| 5,152,435 | 10/1992 | Stand et al. | 222/321.9 X |
| 5,363,993 | 11/1994 | Mascitelli et al. | 222/321.9 |

FOREIGN PATENT DOCUMENTS

| | | | |
|---|---|---|---|
| 404597 | 9/1966 | Australia | 222/321.7 |
| 0 340 724 | 2/1989 | European Pat. Off. . | |
| 0 469 368 A3 | 2/1992 | European Pat. Off. . | |
| 0 505 974 A1 | 3/1992 | European Pat. Off. . | |
| 1236720 | 6/1960 | France . | |
| 718118 | 7/1968 | France . | |
| 3909633 A1 | 10/1990 | Germany . | |
| 39285241 A1 | 3/1991 | Germany . | |
| 404267758 | 9/1992 | Japan | 222/321.9 |
| 415 486 | 6/1964 | Sweden . | |

*Primary Examiner*—Kevin P. Shaver

*Attorney, Agent, or Firm*—Watson Cole Stevens Davis, P.L.L.C.

[57] ABSTRACT

A dosing pump for liquids has a cylindrical chamber for receiving the liquid to be dispensed, a piston located in the chamber slidable between a rest and a dispensing position. A valve near the inlet of the cylindrical chamber closes the chamber to block incoming liquid flow when the pump is moved to the dispensing position and opens for drawing liquid into the chamber as the piston returns to the rest position. A valve near the outlet of the pump allows liquid flow to the outlet during the dispensing stroke and blocks the outlet during the return stroke. The pump is formed of one or more compatible plastic materials which are recyclable and compatible so that the entire pump may be recycled as a unit without disassembly and sorting of parts.

12 Claims, 3 Drawing Sheets

PLASTIC DOSING PUMP FOR DISPENSING LIQUIDS FROM CONTAINERS

BACKGROUND OF THE INVENTION

1. Field of the Invention

The invention is a plastic dosing pump for dispensing liquids from containers, generally made of plastic, too.

2. General State of the Art

As everybody knows, pumps for dispensing liquids from containers are widespread. They are mainly used, for example, to dispense liquid soaps, creams and other types of detergents or cosmetics.

The pumps used at the moment in most dispensers have parts made of plastic material and others made of steel, such as the return springs.

The presence of two different materials involves problems in recycling the material.

As a matter of fact, if the pump were completely made of plastic material, the plastic would be salvaged to be ground without any difficulties, while on the contrary the presence of ferrous material makes grinding impossible, since in this case it is first necessary to sort out plastic from iron in order to subsequently grind plastic.

Because of these difficulties, the pumps for dispensing liquids described above do not undergo the recycling of the material and consequently involve problems as to the disposal of wastes.

A known kind of pumps, even if without metallic parts, is composed of parts made of plastic materials which are not, however, compatible with one another, so that the material obtained after grinding can be recycled, but it cannot be used again since it is made of incompatible plastic materials.

Some pumps are also known that, instead of a spring, use a plastic bellows as elastic element, which is obtained by means of blow molding.

Said bellows consists of several elements which are substantially toroidal and placed one on the other, so that, as the cross-section shows, the bellows profile has a sequence of expansions and constrictions on horizontal planes.

With this type of profile it is necessary to carry out the molding by means of the blow molding process because it is obviously difficult to make an injection mold, since it would require a tap which actually could not be taken out. The aim of the invention is to get over the difficulties explained above.

SUMMARY OF THE INVENTION

One of the goals of the invention is to carry out a pump for dispensing liquids made of one or more plastic materials compatible with one another that can be recycled and used again.

Another aim is to get a pump substantially cheaper than that already known as far as both the materials and the assembly cycle are concerned.

All the above mentioned goals and others that will be better highlighted below have been achieved by a dosing pump for liquids to be connected to a container, comprising:

a cylindrical chamber receiving the liquid to be dispensed;

a partly hollow piston working inside said cylindrical chamber;

a valve also placed inside said cylindrical chamber, coaxial with respect to said piston;

check valves;

at least an elastic element that makes the piston go back to its rest position after sending out the liquid, characterized in that said elastic element is a bellows made of plastic, carried out by injection molding and having a spiral-shaped side surface.

To advantage, according to the invention, the spiral shape of the outer surface of said bellows makes it possible to carry out the bellows by the injection molding of thermoplastic material, making use of a tap that can be fastened on or unfastened from the die respectively by screwing or unscrewing it.

The possibility of using the injection molding process, instead of the blow molding process, allows one to economize on molding time and as a consequence, in conclusion, to achieve a cheaper bellows compared to the different-shaped bellows obtained with the blow molding process.

The saving which can be achieved on the cost of the dosing pump, even if it only concerns the bellows of said pump, is in any case convincing, if we consider the quantity of pieces that are produced and demanded by the market.

Furthermore, the possibility of making such pumps compatible with the needs connected with the recycling of the material solves one of the most important problems we have to face nowadays.

Besides, to advantage, the materials making up the pump are all plastic materials, which, even if different, belong to the same family of organic plastic materials and can consequently be used again.

BRIEF DESCRIPTION OF THE DRAWINGS

Other advantages and distinctive features of the invention in question will be better highlighted in the description of two applications, chosen among many, of the invention illustrated in the attached tables.

DESCRIPTION OF THE PREFERRED EMBODIMENT

Figure 3:
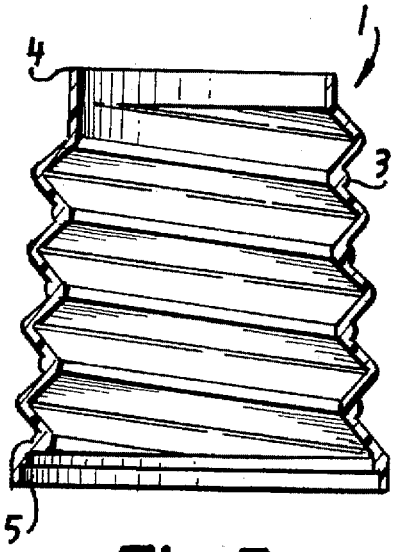
FIG. 3 shows a cross section of a bellows with a conic-shaped spiral.
Figure 4:
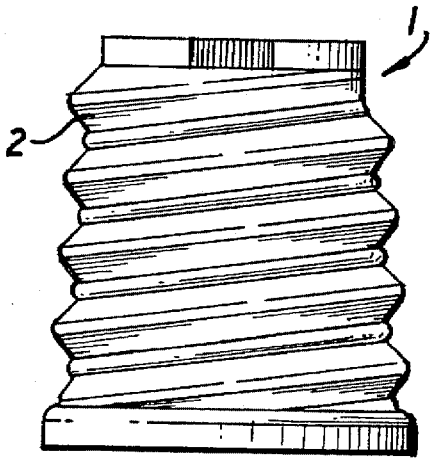
FIG. 4 shows a side view of the bellows of FIG. 3.

With reference to the above mentioned figures it can be noticed in FIG. 4 that the bellows, referred to as a whole by 1, shows a truncated-cone-shaped surface 2 and this is also evident in the cross section of FIG. 3. Such a special shape allows the mold tap to respectively screw on and unscrew off the die during the injection molding and consequently makes it possible to take out both the tap and the manufactured product.

FIG. 3 also shows that, in the receding parts of the cross section, the profile is thicker, as it is shown in 3, obviously to strengthen the bellows on the bending points which are subject to greater stress, without stiffening said bellows.

Figure 1:
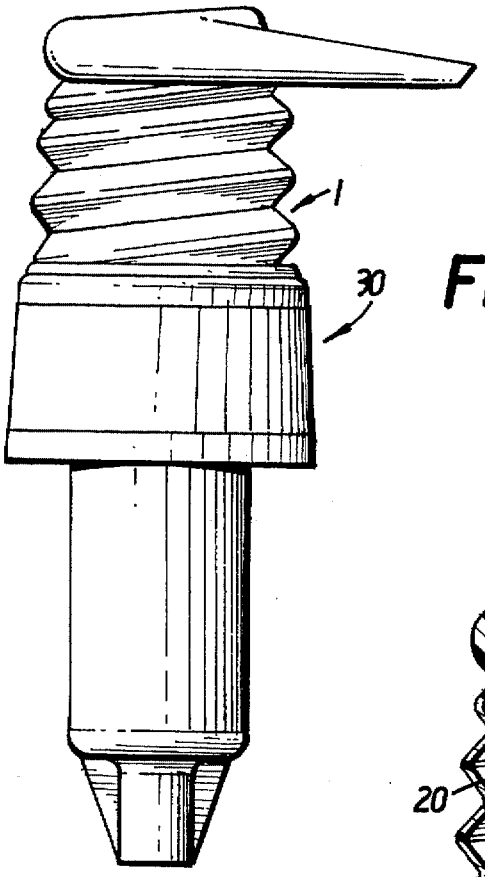
FIG. 1 shows the pump object of the present invention in perspective.
Figure 2:
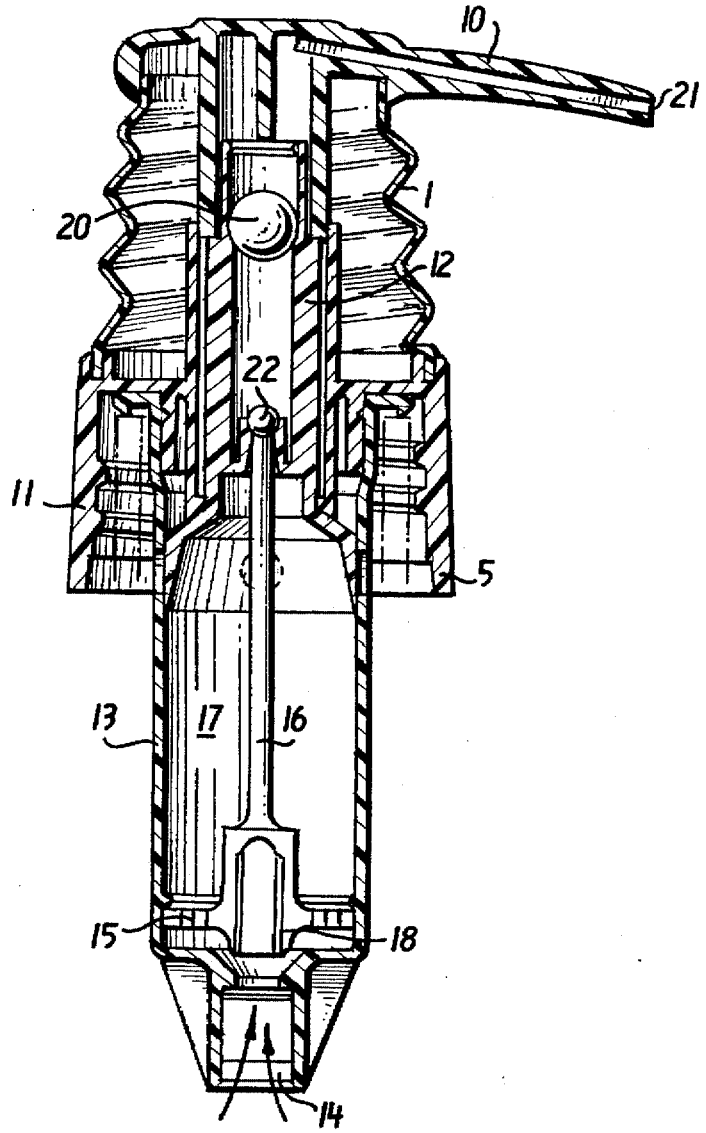
FIG. 2 shows a cross section of the pump object of the present invention.

Bellows 1 is open on the upper rim 4 and on the lower rim 5; more precisely rim 4 is placed on the lower part of the dispenser element 10 of FIG. 2, while the lower part 5 fits on the cylindrical element 11 that screws on the container, which is not shown in FIG. 2.

Figure 5:
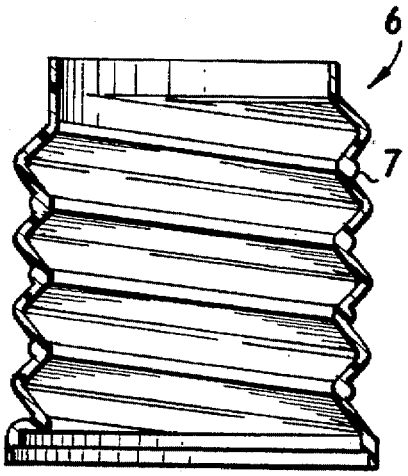
FIG. 5 shows an executive variant of the bellows of the invention here carried out according to the profile of a cylindrical spiral.
Figure 6:
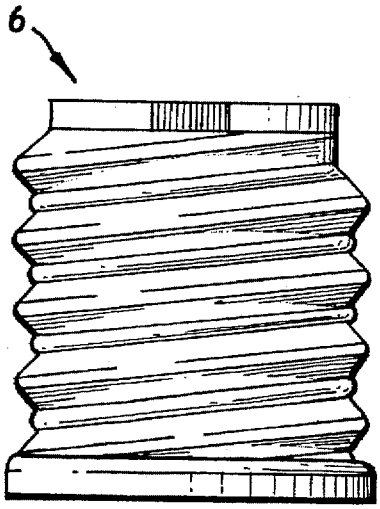
FIG. 6 shows a side view of the bellows of FIG. 5.

FIGS. 5 and 6 show a variant of the bellows referred to as a whole by 6; the difference lies in the fact that the side surface of said bellows is cylindrical-spiral-shaped instead of conic-spiral-shaped.

Obviously, the possibility of molding thermoplastic material by injection has been left unchanged, since the tap can get into the inside of the die by screwing and then move by unscrewing after the cast and this is due to the fact that the outer and inner surface of the bellows is spiral-shaped.

Also in the case of the variant of FIGS. 5 and 6 the thickening of the material 7 is envisaged in the receding parts of the bellows, so that said bellows is strengthened on the weakest parts which are subject to greater stress during the compression.

FIG. 2 shows that the bellows of the invention, the same that can be seen in FIGS. 3 and 4, has been set up on a pump that works in a known way. Actually the dispenser element 10 is connected to a piston 12 sliding inside a cylindrical chamber 13; the liquid to be dispensed flows inside said chamber first through hole 14 and then through the distribution holes 15, which are at the bottom 18 of the valve shown generally at 16 having a lower portion engaging the inside of the cylindrical chamber 13 (as shown) and works as a valve element along with the upper ball 22.

The following outlines basically describe the operation of the dosing pump object of the invention, which is however well known.

In such a pump, referred to as a whole by 30, when the dispenser element 10 is pushed down, it pulls also the piston 12 which reaches the end of stroke and makes the valve 16 position itself so that the opening 14 is closed by its bottom 18.

When the dispenser element is loosened, because of the spring back of bellows 1 also the piston 12 moves back upwards. This way it causes also a depression inside the container of the liquid and consequently the liquid is pulled out of the container and fills the interior 17 of the cylindrical chamber 13. The liquid flows through hole 14 and through the other holes 15.

Pushing down the dispenser element 10 again, both the first 12 and the valve 16 lower, so that hole 14 is closed from the bottom 18 of said valve 16. This way, since the pressure of piston 12 goes on inside the chamber 13, the liquid contained in it flows through the space created by the backlash existing between the inner diameter of the piston 12 concerning the rod of the valve 16 and the outer diameter of the rod of said second piston 16. The liquid, lifting the ball 20, reaches the opening 21.

When the pressure on the dispenser element 10 stops, the reversal of the piston 12 causes the reversal upwards of the valve 16 and its consequent disjunction from the bottom, while the ball 20 gets to the closing position, so that another quantity of liquid reaches the inner space 17 of the chamber 13 through hole 14 and holes 15, so the chamber is full of liquid ready to be dispensed again.

Figure 7:
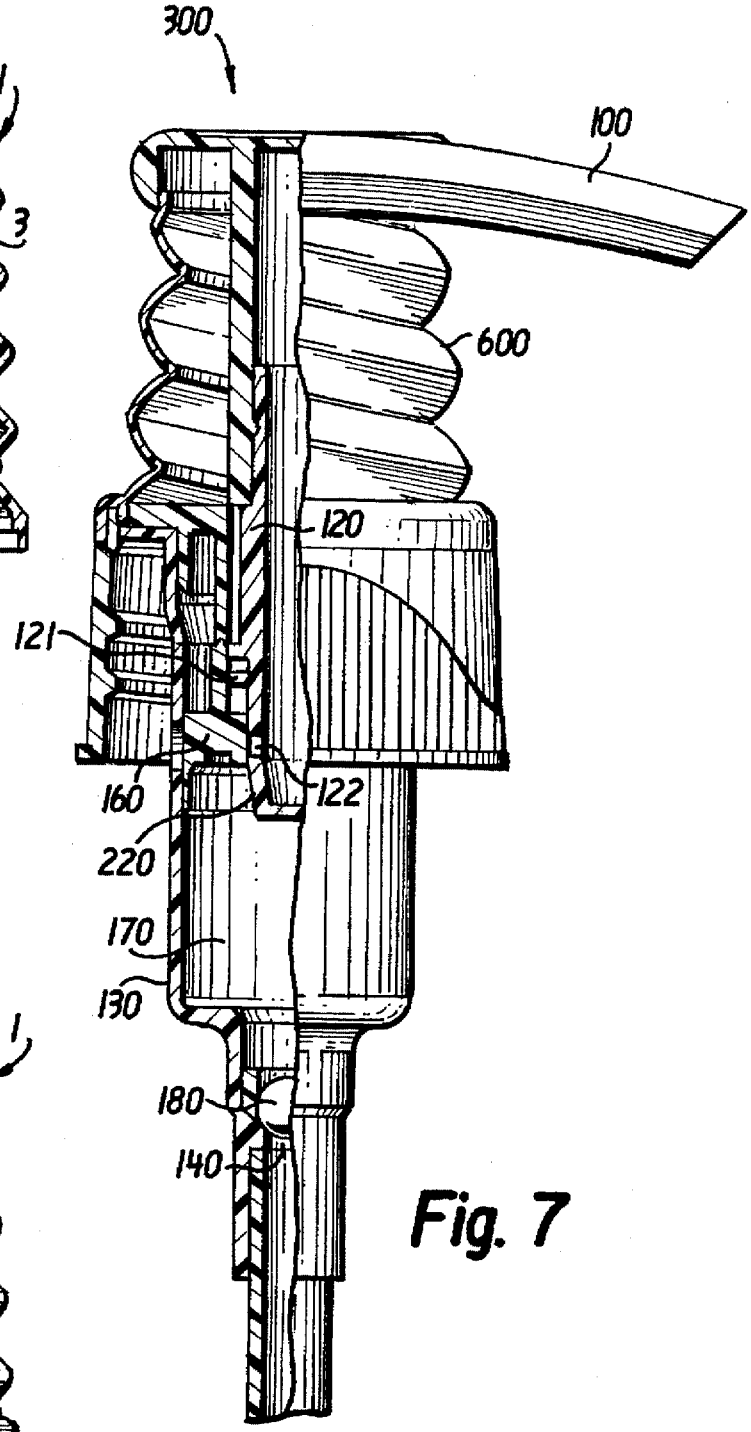
FIG. 7 shows an executive variant of the pump object of the present invention represented in its rest position.
Figure 8:
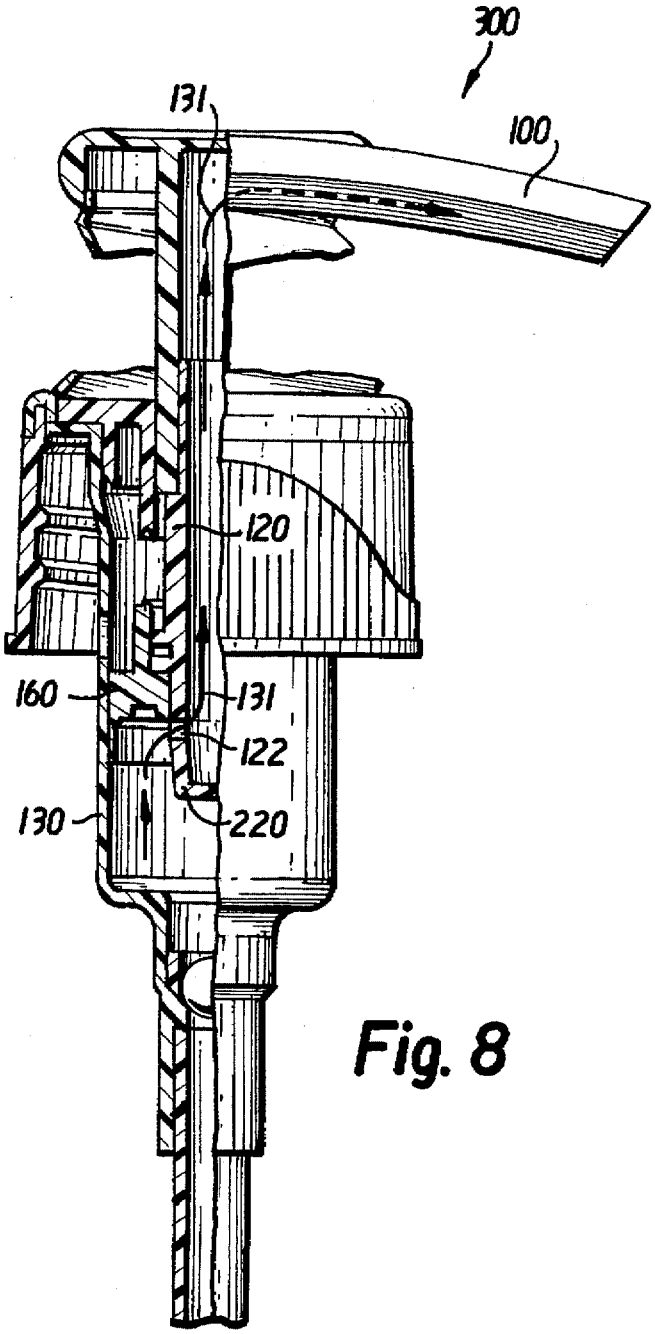
FIG. 8 shows the executive variant of the pump represented in FIG. 7 while dispensing the product.

FIGS. 7 and 8 show an executive variant of the pump of the invention, where it can be seen that in such a pump too, referred to as a whole by 300, the dispenser element 100, when it is pushed down, pulls also a first hollow piston 120 connected to it.

The latter, in turn, pulls downwards also the valve 160 by means of the projections 121; said valve 160, as it can be observed, is placed on the outside of the piston 120 and in the inside of the cylindrical chamber 130, so as to cause the closing of the passage 140 by means of the valve element consisting of the ball 180.

When the dispenser element is loosened, because of the spring back of bellows 600 the piston 120 and the valve 160 move back upwards, so that the inner volume 170 of the cylindrical chamber 130 is filled by the liquid coming from the underlying container and flowing through the passage 140 left free by the valve element 180 which is raised.

Pushing down the dispenser 100 again, the liquid contained in the volume 170 of the chamber 130 goes into the piston 120 by direction 131 and flows outwards through the dispenser element 100, after going through hole 122 made at the end 220 of the piston, where said end acts as a valve element.

The above description of the invention has consequently highlighted that all the aims of the invention have been achieved, since they lie in the fact that it is possible to carry out a pump for dispensing liquids made of plastic material only.

The elements composing the pump object of the invention are preferably made of polypropylene and polythene, which can be both recycled and used again after being ground because they are perfectly compatible, since they belong to the polyolefin family.

Moreover, the bellows, which acts as an elastic element of the pump, has been carried out by injection molding.

Any executive variant is to be considered as completely protected by the invention in question.

I claim:

1. A dosing pump for dispensing liquid adapted to be connected to a container for such liquid, comprising:

a dispensing element;

a cylindrical chamber in flow communication with the dispensing element and having an inlet for receiving the liquid to be dispensed from the container when connected thereto;

a piston slidably mounted within the cylindrical chamber having a stroke for motion between a rest position and a dispensing position at corresponding opposite rest and dispensing ends of the stroke;

valve means coaxially located with respect to the cylindrical chamber, and movable with respect to the piston between open and closed positions and including a first valve element in communication with the inlet operative to close when the piston is urged in a direction towards the dispensing position to block liquid flow into said cylindrical chamber, and to open when first piston is urged in a direction towards the rest position for allowing liquid flow through the inlet and into the chamber, and a second valve element located between the cylindrical chamber and the dispensing element and operative between open and closed positions for allowing liquid flow from the cylindrical chamber to the dispensing element when the piston is urged in the direction of the dispensing position, and operative to block liquid flow to the dispensing element when the piston is released; and an elastic element for urging the piston to its rest position from the dispensing position, wherein the elastic means includes a plastic bellows formed by injection molding and having a sidewall in the form of a spiral shaped side surface.

2. A dosing pump according to claim 1 wherein the first valve element comprises a ball located at the inlet to the cylindrical chamber.

3. The dosing pump according to claim 1 wherein the second valve element comprises a first ball located between the piston and the dispensing element.

4. The dosing pump according to claim 3 wherein the second valve element includes a second ball located between the piston and the first ball.

5. The dosing pump according to claim 1 wherein the second valve element comprises a hollow cylinder having a sidewall portion coaxial with and slidable within the piston, and having an open distal end and an aperture in the sidewall portion proximate the piston, said hollow cylinder being movable with the piston between respective closed and open positions and in flow communication with the cylindrical chamber when the piston is moved towards the dispensing position and closed for blocking flow communication with the cylindrical chamber when the piston is moved away from the dispensing position towards the rear position.

6. The dosing pump according to claim 1 wherein the first valve element comprises a bottom of the valve slidable within the cylindrical chamber for engaging the inlet of the cylindrical chamber when the piston is moved to the dispensing position.

7. The dosing pump according to claim 6 wherein the bottom of the valve has holes in communication with the cylindrical chamber.

8. The dosing pump according to claim 1 wherein the sidewall of the plastic bellows is in the form of a conic spiral.

9. The dosing pump according to claim 1 wherein the spiral shaped sidewall has protruding and receding coaxial spiral elements, and wherein the receding spiral elements further include a reinforced thickened region.

10. The dosing pump according to claim 1 formed of a polyolefin plastic.

11. The dosing pump according to claim 10 formed of a plurality of compatible recyclable plastics.

12. The dosing pump according to claim 10 formed of compatible polypropylene and polyethylene recyclable plastics.

* * * * *

UNITED STATES PATENT AND TRADEMARK OFFICE

CERTIFICATE OF CORRECTION

PATENT NO. : 5,673,824

DATED : October 7, 1997

INVENTOR(S) : Evans Santagiuliana

It is certified that error appears in the above-identified patent and that said Letters Patent is hereby corrected as shown below:

Title page, below item [19], the inventor's name should be -- Santagiuliana.
item [75], insert--Evans Santagiuliana instead of Santagiuliana Evans--.

Signed and Sealed this

Second Day of June, 1998

*Attest:*

*Attesting Officer*

Bruce Lehman

BRUCE LEHMAN

*Commissioner of Patents and Trademarks*